US006164252A

United States Patent [19]

Kuhn et al.

[11] Patent Number: 6,164,252

[45] Date of Patent: Dec. 26, 2000

[54] RECIPROCATING PISTON ENGINE WITH A SWIVEL DISK GEAR

[75] Inventors: Peter Kuhn, Weinheim; Roland Cäsar, Stuttgart, both of Germany; Frank Obrist, Dornbirn, Austria

[73] Assignees: Obrist Engineering GmbH, Lustenau, Austria; Daimler Chrysler AG, Stuttgart, Germany

[21] Appl. No.: 09/308,418

[22] PCT Filed: Nov. 3, 1998

[86] PCT No.: PCT/IB98/01759

§ 371 Date: May 18, 1999

§ 102(e) Date: May 18, 1999

[87] PCT Pub. No.: WO99/24715

PCT Pub. Date: May 20, 1999

[30] Foreign Application Priority Data

Nov. 11, 1997 [DE] Germany ..... 197 49 727

[51] Int. Cl.[7] ..... F02B 75/18

[52] U.S. Cl. ..... 123/56.3; 123/56.4

[58] Field of Search ..... 123/56.3, 56.4

[56] References Cited

U.S. PATENT DOCUMENTS 4,175,915 11/1979 Black et al. .

4,294,139 10/1981 Bex et al. ..... 74/839

4,433,596 2/1984 Scalzo ..... 74/839

5,113,809 5/1992 Ellenburg ..... 123/58 BA 5,782,219 7/1998 Frey et al. ..... 123/56.3

FOREIGN PATENT DOCUMENTS 35 45 200 7/1986 Germany .

44 11 926 10/1994 Germany .

*Primary Examiner*—Willis R. Wolfe

*Assistant Examiner*—Katrina B. Harris

*Attorney, Agent, or Firm*—Ladas & Parry

[57] ABSTRACT

The reciprocating piston engine has an annular swivel disk (6), driven by the engine shaft (5) and whose inclination with respect to the latter is adjustable, for driving circumferentially juxtaposed reciprocating pistons (2). For this purpose it is connected in articulated manner both to a sliding sleeve (21) axially guided on the engine shaft (5) and to a driver (13), which transmits the driving force and which is spaced from the engine shaft (5). As a result of the annular shape of the swivel disk, which is advantageous both dynamically and from the manufacturing standpoint a space-saving, articulated engagement of the driver (13) in a radial bore (16) of the swivel disk (6) is rendered possible.

10 Claims, 2 Drawing Sheets

RECIPROCATING PISTON ENGINE WITH A SWIVEL DISK GEAR

BACKGROUND OF THE INVENTION

The invention relates to a reciprocating piston engine with a swivel disk whose inclination with respect to the engine shaft is adjustable and is driven by said engine shaft, in that it is connected in articulated manner both to a sliding body axially guided on the engine shaft and to a driver transmitting the drive force and spaced from the engine shaft, the pistons having in each case an articulated arrangement on which the swivel disk is in sliding engagement.

DESCRIPTION OF RELATED ART

A reciprocating piston engine of this type is known from DE-A-44 11 926 (Japanese application 81944). In said engine the driver is in two parts, a first driver part fixed to the engine shaft is arranged with a significant spacing alongside the swivel disk and a second driver part engaging in articulated manner in the first forms a lateral extension of the swivel disk. This construction suffers from the disadvantage that it significantly codetermines the axial minimum length of the engine. In addition, as a result of its lateral extension, the swivel disk having a thickened hub part has a relatively high moment of inertia with a centre of gravity relatively remote from the rotation axis, so that a sudden change to the rotational speed with corresponding inertia leads to an inclination adjustment of the swivel disk.

BRIEF SUMMARY OF THE INVENTION

The problem of the invention is to find a reciprocating piston engine of the aforementioned type which, in the case of limited effort and expenditure for its manufacture, allows a particularly compact construction opposing an adjusting movement of the swivel disk with limited inertia and frictional forces and which ensures an exact maintenance of the inner dead-point position of the reciprocating pistons so as to prevent clearances.

According to the invention, this problem is solved in that the swivel disk is in the form of an annular disk and at one point of its circumference has an at least radially inwardly open engagement space, in which engages the head of a driver firmly connected to the engine shaft.

This avoids a laterally positioned driver leading to higher inertia forces, a greater overall length and greater manufacturing costs.

Advantageous embodiments of the invention and their advantages are described hereinafter relative to the attached drawings, wherein show:

DETAILED DESCRIPTION OF THE INVENTION

Figure 1:
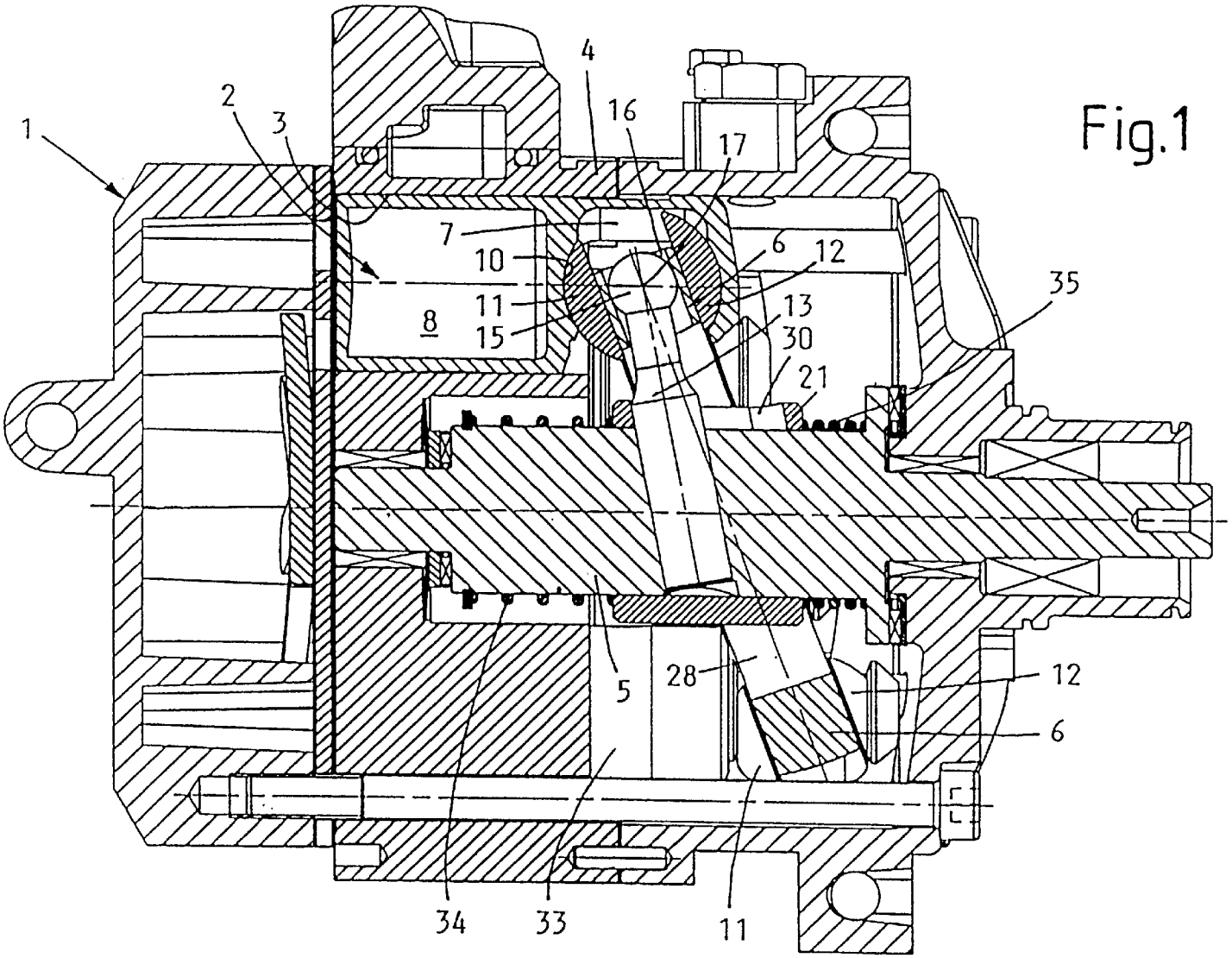
FIG. 1 An axial section through an embodiment of a reciprocating piston engine, in which the annular disk has its greatest inclination.

The reciprocating piston engine 1 e.g. has seven pistons 2, which are juxtaposed in the circumferential direction of the engine and are guided in cylinder bores 3 of the engine case 4. The stroke movement of the pistons takes place through the engagement of an annular disk 6 inclined to the engine shaft 5 in an engagement chamber 7, which is adjacent to the closed cavity 8 of the piston 2. For a substantially clearance-free sliding engagement in each inclined position of the annular disk 6 between the latter and the spherically curved inner wall 10 of the engagement chamber 7 are bilaterally provided spherical segments 11, 12, so that the inclined disk 6 slides between them during its rotation.

Figure 2:
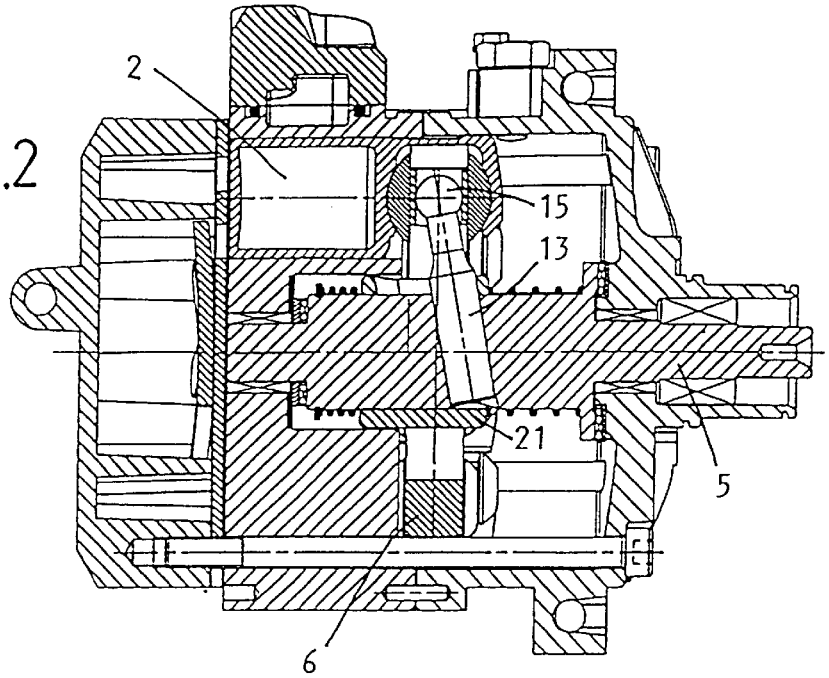
FIG. 2 A view corresponding to FIG. 1 with minimum annular disk inclination.
Figure 3:
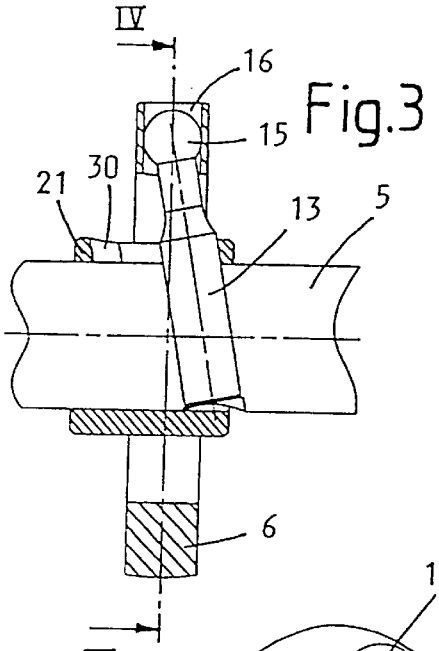
FIG. 3 A separate representation of the annular disk with its driver, corresponding to part of FIG. 2.
Figure 4:
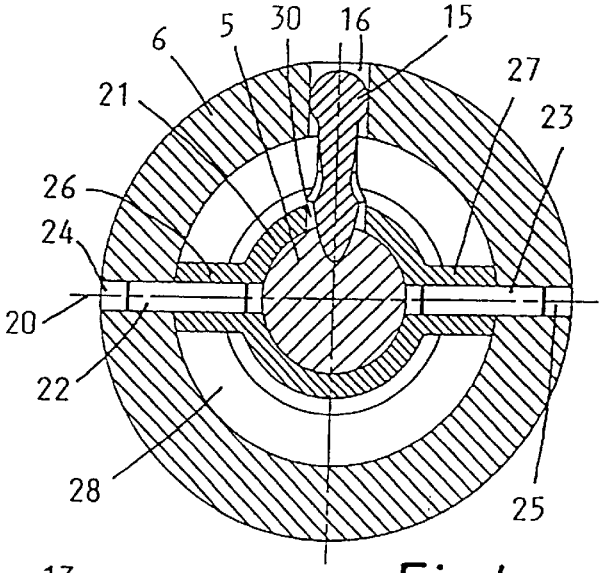
FIG. 4 A cross-section along line IV—IV in FIG. 3.
Figure 5:
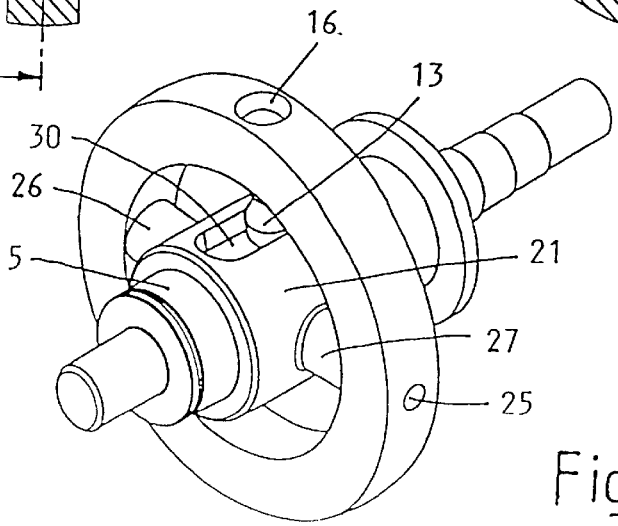
FIG. 5 A perspective view of the arrangement of FIGS. 3 and 4.

The drive transmission from the engine shaft 5 to the annular disk 6 takes place through a driver 13, fixed in the engine shaft 5 and whose e.g. spherical head 15 engages in a radial bore 16 of the annular disk 6. The position of the driver head 15 is chosen in such a way that its centre 17 coincides with that of the ball of the spherical segments 11, 12. Its centre is also located on a circle interconnecting the geometrical axes of the seven pistons and also on a circle linking the centres of the spherical shape of the articulations 11, 12 of the pistons 2. As a result the dead-point position of the pistons 2 visible in the upper area of FIGS. 1 and 2 is precisely determined and a minimum clearance is ensured. The head shape of the free driver end makes it possible to modify the inclination of the annular disk 6, in that the driver head 15 forms a bearing body for the pivoting movement of the annular disk 6 modifying the stroke magnitude of the pistons 2. The shape of the engagement space 16 and/or the head 15 of the driver 13 can be chosen differently for producing different kinematics.

A further prerequisite for a pivoting of the annular disk 6 is the displaceability of its bearing spindle 20 towards the engine shaft 5. For this purpose the bearing spindle 20 is formed by two equiaxial bearing pins 22, 23 mounted on either side of a sliding sleeve 21, which are also mounted in radial bores 24, 25 of the annular disk 6. The sliding sleeve 21 has for this purpose preferably bilateral bearing sleeves 26, 27, which bridge in spoke-like manner the annular space 28 between the sliding sleeve 21 and the annular disk 6. The limitation of the displaceability of the bearing spindle 20 and consequently the maximum inclined position of the annular disk 6 results from the driver 13, in that the latter penetrates an elongated hole 30 provided in the sliding sleeve 21, so that the latter finds stops at the ends of the elongated hole 30.

The force for the angular adjustment of the annular disk 6 and therefore for the control of the machine results from the sum of the pressures acting against one another on either side of the pistons 2, so that said force is dependent on the pressure in the drive space 33. For the control of said pressure it is possible to provide a flow connection with an external pressurized gas source. The higher the pressure at the drive space side of the pistons 2 or in the drive space 33 compared with the pressure on the opposite side of the pistons 2, the smaller the stroke magnitude of the pistons 2 and consequently the efficiency of the engine.

The setting of the position of the sliding sleeve 21 and consequently the stroke magnitude of the pistons for controlling the efficiency of the machine can also take place by at least one spring 34, 35 cooperating with the sliding sleeve 21. The sliding sleeve 21 is preferably enclosed between two helical springs 34, 35, which are positioned on the circumference of the engine shaft 5.

The position of the sliding sleeve 21 decisive for the efficiency is also codetermined by inertia forces acting on the annular disk 6, in that with rising rotational speed the annular disk 6 is raised in the direction towards the position of FIG. 2, corresponding to a reduction in the stroke magnitude of the pistons 2 and consequently the efficiency. As a result of the invention, this operation is significantly aided, because the mass of the annular disk 6 compared with the known swivel disks is positioned peripherally towards the outside through avoiding a solid construction and a laterally shaped on driver.

Besides the design of the swivel disk 6 being advantageous for the dynamic behaviour, the limitation of its design to the annular shape leads to the further advantage of greatly simplified manufacture particularly during the finishing of its lateral faces by lapping. Finally, the annular disk only takes up a small amount of space in the engine case, so that also in the axial direction of the engine a particularly compact construction is possible and its installation as a compressor of a motor vehicle air conditioning system is assisted.

What is claimed is:

1. Reciprocating piston engine with a swivel disk, whose inclination to the engine shaft is adjustable and which is driven by said engine shaft, in that it is connected in articulated manner both to a sliding body axially guided on the engine shaft and also to a driver transmitting the driving force and spaced from the engine shaft, the pistons having in each case an articulation arrangement, on which the swivel disk is in sliding engagement, wherein the swivel disk is in the form of an annular disk and on one point of its circumference has an at least radially inwardly open engagement space, in which engages the head of a driver firmly connected to the engine shaft.

2. Reciprocating piston engine according to claim 1, wherein the head of the driver is provided at the free end of a driver projecting away from the engine shaft.

3. Reciprocating piston engine according to claim 2, wherein the driver projects in sloping manner away from the engine shaft, so that in a central inclination position of the annular disk the driver axis is directed radially to the annular disk.

4. Reciprocating piston engine according to claim 1, wherein the annular disk has a radial bore forming the engagement space and the head of the driver is shaped like a ball.

5. Reciprocating piston engine according to claim 4, wherein the centre of the head of the driver is located on a circle, which links the centres of the spherical shape of spherical segmental articulations of the pistons.

6. Reciprocating piston engine according to claim 4, wherein the centre of the head of the driver is located on a circle interconnecting the geometrical axes of the seven pistons.

7. Reciprocating piston engine according to claim 1, wherein the articulated connection to a sleeve-like sliding body embracing the engine shaft is provided by two bearing pins, which are equiaxially mounted on radially opposite sides on the one hand in the annular disk and on the other hand in the sliding body.

8. Reciprocating piston engine according to claim 7, wherein the bearing pins are mounted in equiaxial bearing sleeves projecting radially from the sleeve-like sliding body and which bridge the radial space between the sliding body and the annular disk.

9. Reciprocating piston engine according to claim 1, wherein the sliding body is axially guided in sleeve-like manner on the engine shaft, the driver extending from the engine shaft to the annular disk extending through an elongated hole of the sliding body, so that on either side the sliding body finds a stop on the driver.

10. Reciprocating piston engine according to claim 1, wherein spring elements are provided on both ends of the sliding body.

* * * * *